US005600963A

United States Patent [19]

Koo et al.

[11] Patent Number: 5,600,963

[45] Date of Patent: Feb. 11, 1997

[54] INDOOR UNIT OF AN AIR CONDITIONER SYSTEM

[75] Inventors: Byung K. Koo, Seoul; Jin S. Chung, Suwon; Ki Y. Lee, Suwon; Younsup Yoon, Suwon; Kyung H. Yoon, Suwon, all of Rep. of Korea

[73] Assignee: Samsung Electronics Co., Ltd., Suwon, Rep. of Korea

[21] Appl. No.: 515,617

[22] Filed: Aug. 16, 1995

[30] Foreign Application Priority Data

| | | | |
|---|---|---|---|
| Aug. 20, 1994 | [KR] | Rep. of Korea | 94-21045 |
| Aug. 20, 1994 | [KR] | Rep. of Korea | 94-21046 |
| Aug. 20, 1994 | [KR] | Rep. of Korea | 94-21048 |
| Aug. 20, 1994 | [KR] | Rep. of Korea | 94-21049 |
| Aug. 20, 1994 | [KR] | Rep. of Korea | 94-21050 |
| Jan. 28, 1995 | [KR] | Rep. of Korea | 95-1450 |
| Jan. 28, 1995 | [KR] | Rep. of Korea | 95-1452 |
| Jan. 28, 1995 | [KR] | Rep. of Korea | 95-1454 |

[51] Int. Cl.[6] ..... F25D 23/12

[52] U.S. Cl. ..... 62/262; 49/388; 220/342; 454/332

[58] Field of Search ..... 62/262, 263; 454/233, 454/288, 321, 332; 49/388; 220/335, 342, 343

[56] References Cited

U.S. PATENT DOCUMENTS

| | | | |
|---|---|---|---|
| 2,896,526 | 7/1959 | Wilson | 454/332 |
| 3,378,199 | 4/1968 | Snell | 454/288 |
| 3,789,619 | 2/1974 | Kincaid et al. | 62/262 |
| 4,573,328 | 3/1986 | Bolton et al. | 62/263 |
| 4,607,500 | 8/1986 | Bolton et al. | 62/262 |
| 5,150,806 | 9/1992 | Glomski | 220/335 |
| 5,230,400 | 4/1993 | Tsunekawa et al. | 62/262 |
| 5,388,426 | 2/1995 | Wada et al. | 62/263 |

*Primary Examiner*—William E. Tapoicai

*Attorney, Agent, or Firm*—Burns, Doane, Swecker & Mathis, L.L.P.

[57] ABSTRACT

An indoor unit of an air conditioning system includes front and rear cases joined together to form a space in which a heat exchanger, fan, and fan motor are housed. A grill member hingedly mounted on the front case has a front air intake opening formed therein. A top air intake opening is formed in an upper side of the rear case. A filter is mounted on a rear side of the grill member to extend across the front air intake opening. An upper portion of the filter underlies the top air intake opening. Edges of the front and rear case overlap one another, and one of those edges forms a slot in which the other edge is received. Boards for carrying electrical components are mounted in an out-of-way manner to minimize the space taken up.

8 Claims, 7 Drawing Sheets

FIG. 4
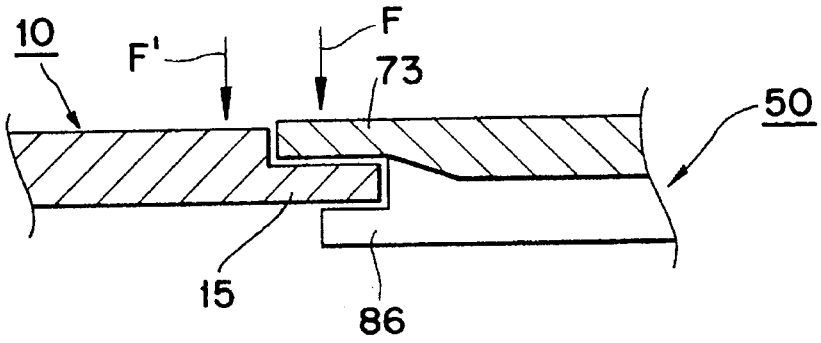
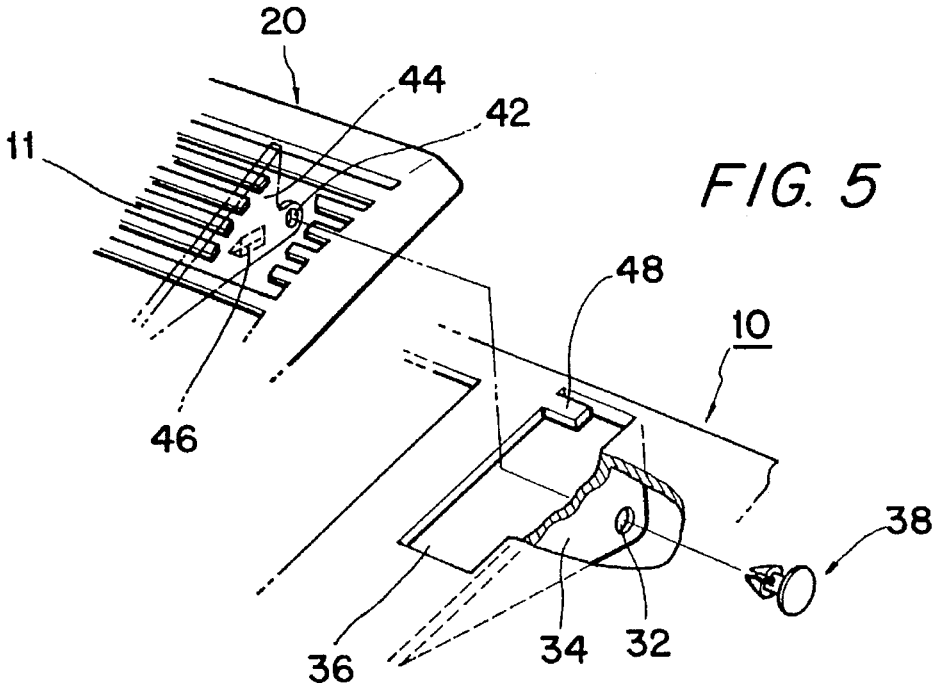
FIG. 5
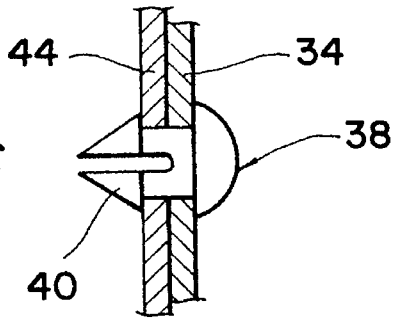
FIG. 6

INDOOR UNIT OF AN AIR CONDITIONER SYSTEM

BACKGROUND OF THE INVENTION

This invention relates to an indoor unit of an air conditioner, and more particularly to an indoor unit of an air conditioner in which front and rear cases are hingedly assembled to house, a detachable filter, with an electrical components mounting board, and a motor.

A conventional indoor unit of an air conditioner system is illustrated in FIG. 8. The indoor unit normally consists of a front case 10 having an intake opening 11 and a discharge opening 13, and a rear case 50 assembled with the front case 10. The rear case 50 contains a heat-exchanger 51 mounted behind the intake opening 11, and a fan 55, driven by a motor 53, located under the heat-exchanger 51.

In this indoor unit, the refrigerant is compressed, by a compressor, to a state of high temperature and pressure and is passed through an outdoor unit (not shown). The condensated refrigerant flows into the heat-exchanger 51 of the indoor unit. With the rotation of the fan 55 the indoor air is drawn into the indoor unit through the opening 11. The air then passes through the heat-exchanger 51, so that the temperature of the air is lowered. The cool air is finally discharged into the area to be cooled through the discharge opening 13.

A controlling apparatus is mounted on the right side portion of the rear case 50 for driving the fan 55 and controlling the level of air volume. In the controlling apparatus, a circuit board having various electronic components is provided. To install the circuit board, as shown in FIG. 12, a compartment 63 must be provided in the side portion of the rear case 50. A control box 65, having the circuit board therein, is put into the compartment 63.

However, since it is necessary to provide the compartment 63 for receiving the control box 65, available space in the rear case 50 is reduced. Further, due to the provision of the compartment, the design of the rear case becomes more complicated and the cost of manufacturing increases.

An electrical components mounting board 67 is provided in the lower portion of the control box 65. The mounting board 67 has a plurality of lamps 69 which display the operating condition, and a switch 71 for selecting the automatic and manual modes. The mounting board 67 is positioned in the control box 65 and subsequently the control box 65, having the mounting board 67, is put into the compartment 63.

That is, two gripping members 77 are formed on the upper left and right edges of the control box 65, respectively. The mounting board 67 is fixed in the control box 65 by the gripping members 77. Further, a couple of shoulders 79 are formed on the upper and the lower upper edges of the control box 65, respectively. The mounting board 67 is positioned on the shoulder 79.

However, due to the large volume of the box 65, a large volume for the rear case 50 is required. Besides, since the box 65 is put into the compartment 63 with the board 67 mounted in the box 65, the assembly becomes complicated. Further, a fastening member is additionally required for preventing the box 65 from moving while in the compartment 63, which involves additional complexity.

For support of respective shafts 57 of the fan motor 53A, a couple of bearing members 59 are provided adjacent both ends of the motor 53. Further, with the shaft 57 being placed on the bearing members 59, brackets 61 are attached to the bearing members 59 by bolts or a similar functional fastening means that will cover the shafts 57.

Since the brackets are shaped as mirror images of each other, a control in the assembling line is required to keep the brackets in proper location, which also increases complicity. Also, since complicated circuit parts and wires are arranged adjacent to the motor mounting place, wires will pass unavoidably over the exposed portion of the motor 53. If the motor becomes over-heated, the synthetic resin coating on the wire might melt. Further, additional components can not be arranged over the motor, and consequently extra space for mounting the components is needed, which increases the difficulty of design.

In addition, the structure of the air intake opening determines the level of air intake noise and heat-exchange efficiency. In the conventional intake opening, as shown FIG. 9, a filter 21 is installed on the inner surface of the front case 10, causing rust to occur.

The air intake opening 11 draws the air through the front portion of the front case 10. Since the front case 10 encompasses the front portion of the heat-exchanger 51, the indoor air is drawn through the front portion of the heat-exchanger, so that the heat-exchange can be accomplished. To increase the heat-exchange efficiency, the rotation speed of the fan must be increased. The higher speed of the fan will cause the local air to be drawn toward the front portion of the heat-exchanger 51.

That is, the active heat-exchange is accomplished in the front portion of the heat-exchanger 51, but in the upper portion air circulation has become poor, which results in bad efficiency of the heat-exchange. Moreover, larger volume of air must be drawn through the intake opening 11, thereby bringing about an increase in intake noise.

Next, a conventional hinge apparatus 30 is shown in FIG. 11 for mounting, the grill member 23 to the front case 10 to facilitate the removal of a rusted filter. The hinge apparatus 30 comprises two brackets 33 each of which has an opening 31, respectively. The brackets 33 are mounted on both upper side inner walls of the front case 10 using screws, etc. The hinge apparatus 30 further comprises two brackets 43 which have an opening 35, respectively. The brackets 43 are mounted on both upper side inner walls of the grill member 21 using screws, etc. A hollow pin 37 is introduced into the aligned openings 31,35 and a bolt 39 is inserted into the pin 37 and is assembled with a nut 47. Around the periphery of the pin 37 is provided a spring 41 which prevents the unwanted dropping or closing of the opened grill member 23.

Because respective brackets 33,43 are attached to the grill member 23 and the front case 10 by screws, etc., the assembly is time consuming. Further, since respective brackets 33,43 are hingedly assembled using the pin 37, the bolt 39 and the nut 47, a large number of parts is required.

Furthermore, adjoining edges of the front case 10 and the rear case 50 are shown in FIG. 10. A platform 15 is formed on the rear upper edge of the front case 10, while an overlapping member 73 is formed on the front upper edge of the rear case 50.

When the front case 10 is assembled to the rear case 50, the overlapping member 73 must be placed on the platform 15. If an external force F is applied to the upper portion of the rear case 50, the platform 15 and over lapping member will deform downwardly together what is worse is if an external force F is applied to the upper portion of the front case 10, only the platform 15 deforms, which brings about the formation of a gap between the platform 15 and the overlapping member 73.

SUMMARY OF THE INVENTION

It is, accordingly, an object of this invention to provide an indoor unit of an air conditioner system with the capacity to increase the heat-exchange efficiency. This is done by forming a plurality of openings for the introduction of a larger volume of intake air, while maintaining a higher cleaning efficiency by installing a filter corresponding more closely to the intake opening.

It is a further object to provide an indoor unit of an air conditioner system with reduced physical size by mounting a minimal quantity of components in the indoor unit.

It is still a further object to provide an indoor unit of an air conditioner with the capability to remove the assembly dimension variation by simplifying the components and achieving an easy assembly process, and therefore minimizing the assembly time.

It is a more further object to provide an indoor unit of an air conditioner capable of heightening user confidence by eliminating the assembly gap by means of reinforcement of the support member of the front and rear case.

According to the present invention, the indoor unit of an air conditioner system comprises a front case including a grill member hingeably attached thereto, and the grill member having an intake opening, a filter arranged on the rear portion of the grill member; a rear case having an intake opening provided in the upper portion of the rear case, so that the body defined by the front and rear cases contains a heat-exchanger, fan and motor; characterized in that the grill member provides a couple of brackets having their respective openings on both upper side ends of the grill member, a couple of openings for accessing the bracket of the grill member are provided on the front door, a couple of brackets for the front case are provided on the inner portion of their respective openings, the bracket has an opening linked to the opening of the grill member by a pin, the pin has an enlargement on its leading portion thereof, the rear case further provides an overlapping member on the front upper wall of the rear case and a plurality of ribs on the undersurface of the overlapping member, and the front case further provides a platform in the rear upper portion of the front case for inserting said platform between the overlapping member and the rib.

Further, a couple of securing means are provided in the rear case for demountably inserting a circuit board having circuit parts mounted thereon, the circuit parts exhibiting the electrical control of the fan and motor.

Furthermore, an electrical components mounting board, including operating display lamps and operation switching components, is mounted in the rear case at an angle to the wall of the rear case, and a moving prohibit member for preventing the board from moving in all directions is also provided.

Next, a bracket for holding the motor is provided in the rear case, while a holding member, which is protrudedly formed on a plate, is placed in the upper portion of the bracket for clamping the electrical wire.

In addition, the bracket of the grill member provides a protrusion on the side surface of the bracket, while a supporting member is provided in the access opening of the front case, resulting in the protrusion being placed on the supporting member when opening the grill member.

Further, the moving prohibiting member comprises a griping member which holds one side portion of the board, while a lip supports the other side portion of the board, formed opposite to either side portion thereof, further a slot is provided in the board for perpendicular penetration of a protuberance extended from the upper surface of the board, the major axis of the slot extending along the arranging direction of the griping member and the neck.

Furthermore, a guiding member is provided so that the filter can extend upwards to a position underlying the top air intake opening of the rear case.

BRIEF DESCRIPTION OF THE DRAWINGS

FIG. 4 is an enlarged vertical cross-sectional view of the "L" portion of FIG. 3;

FIG. 5 is a fragmentary exploded perspective view, partially broken away, of the "M" portion of FIG. 3;

FIG. 6 is a cross-sectional view taken along line A—A of FIG. 3;

DESCRIPTION OF THE PREFERRED EMBODIMENT

Figure 1:
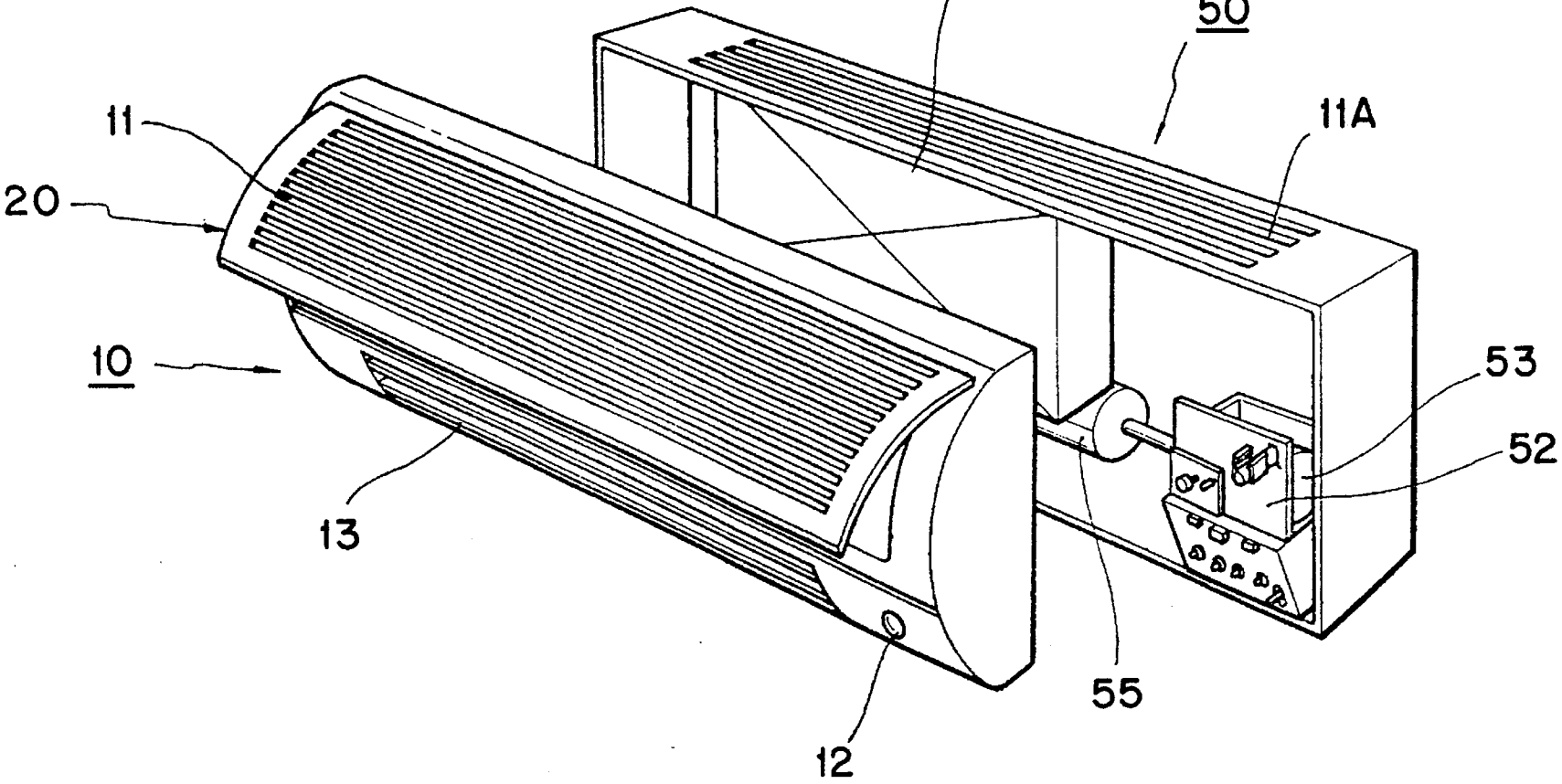
FIG. 1 is an exploded perspective view of an indoor unit according to the present invention.

An indoor unit according to the invention is shown in FIG. 1. The component parts as those of the present preferred embodiment are designated by the same reference numbers as the corresponding parts of the conventional embodiment of FIGS. 8–12, but a detailed description of those parts will be omitted.

The indoor unit comprises a front case 10 having a front intake opening 11 and an outlet opening 13, and a rear case 50 housing a heat-exchanger 51, a fan 55, and a motor 53.

Figure 7:
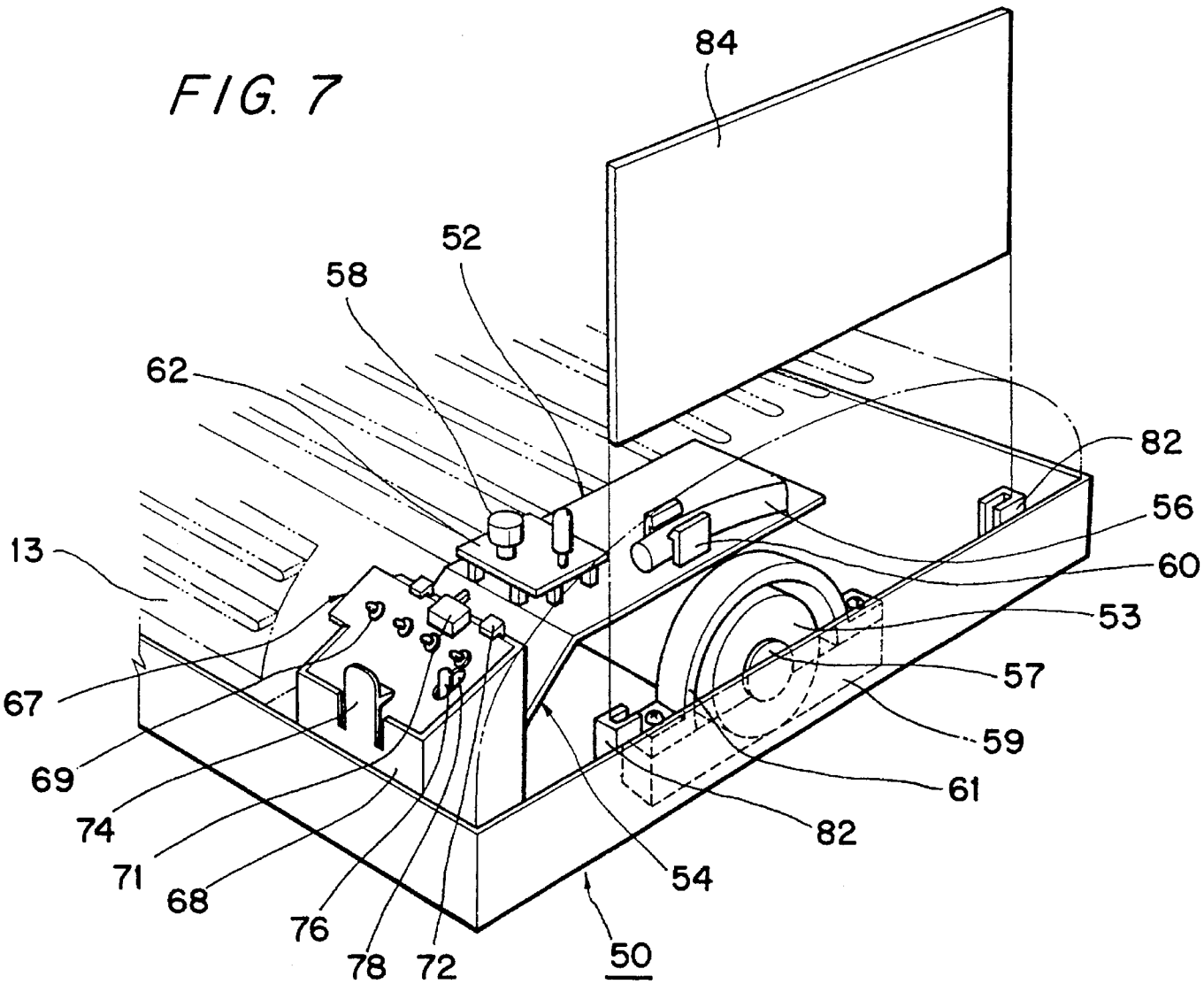
FIG. 7 is a perspective view of the electrical components housed in the indoor unit of FIG. 3.
Figure 8:
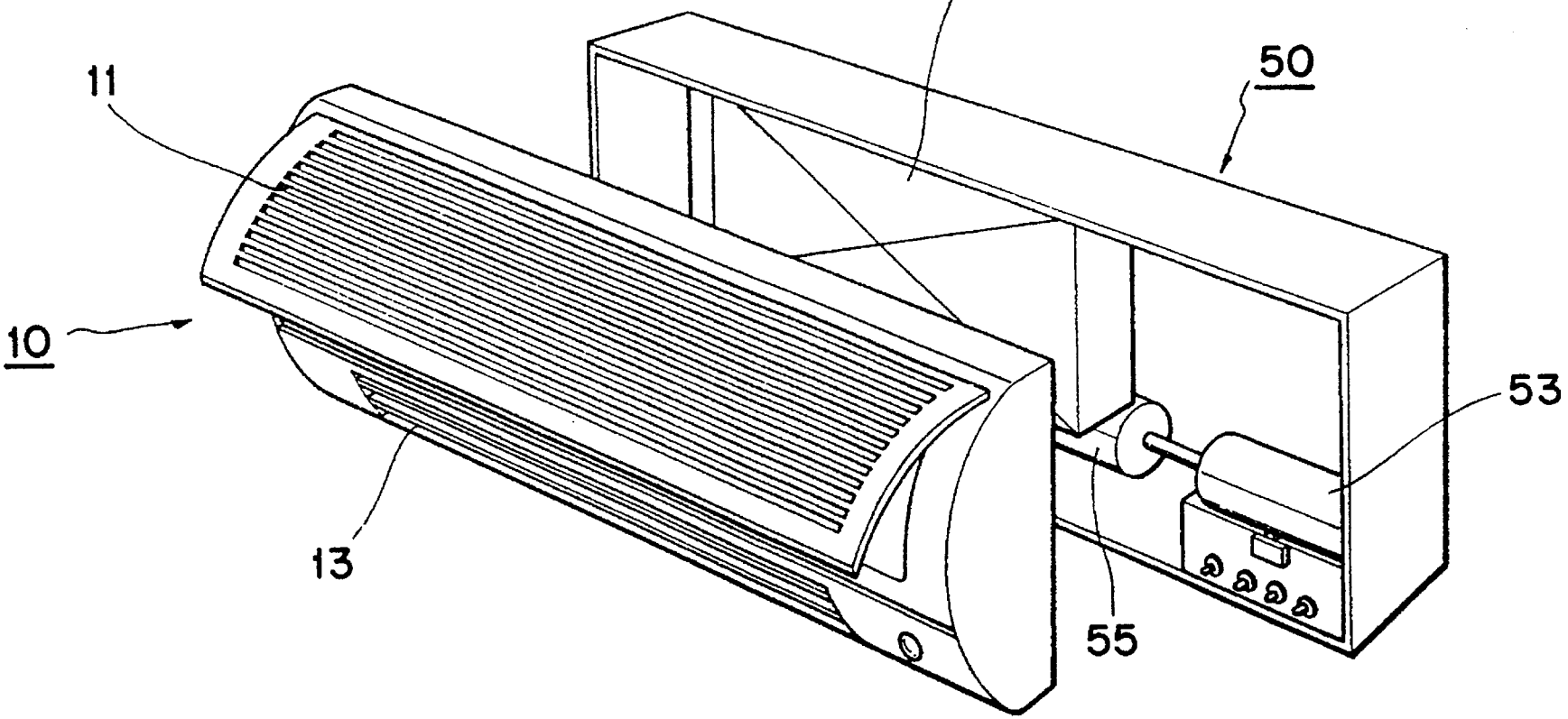
FIG. 8 (PRIOR ART)
FIG. 8 is an exploded perspective view of an indoor unit according to the prior art.
Figure 9:
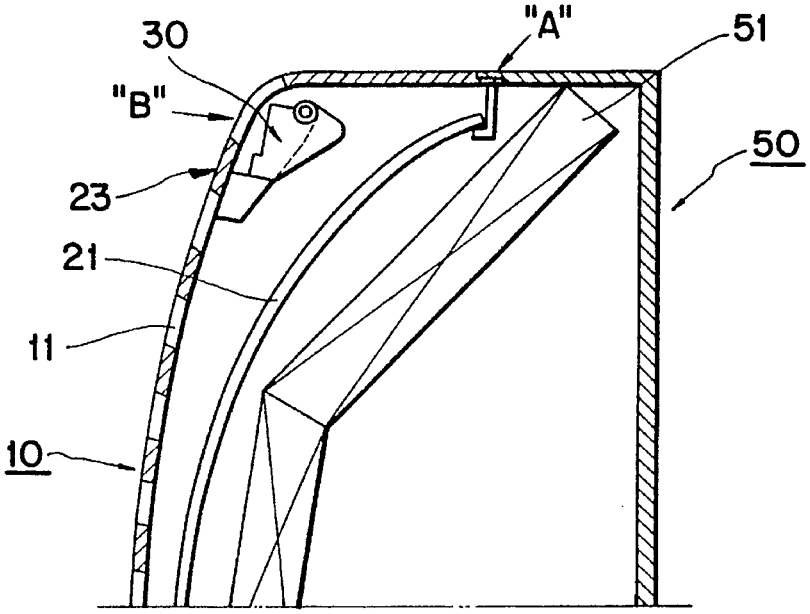
FIG. 9 (PRIOR ART)
FIG. 9 is a vertical cross-sectional view of the assembled indoor unit of FIG. 8.
Figure 10:
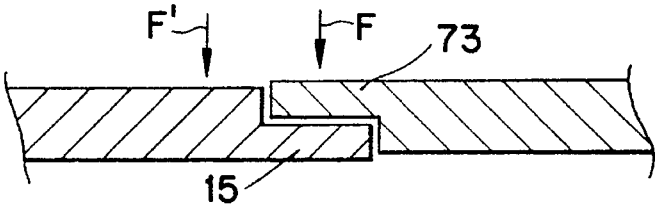
FIG. 10 (PRIOR ART)
FIG. 10 is an enlarged vertical cross-sectional view of the "A" portion of FIG. 9.
Figure 11:
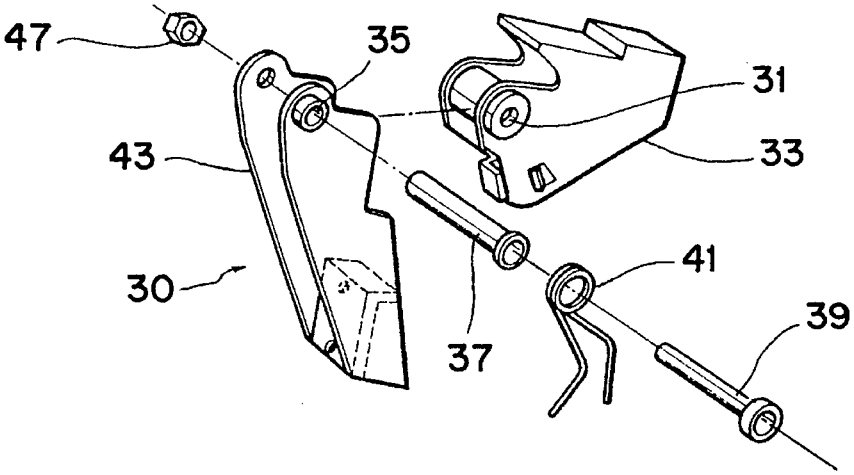
FIG. 11 (PRIOR ART)
FIG. 11 is an exploded perspective view of the "B" portion of FIG. 9.
Figure 12:
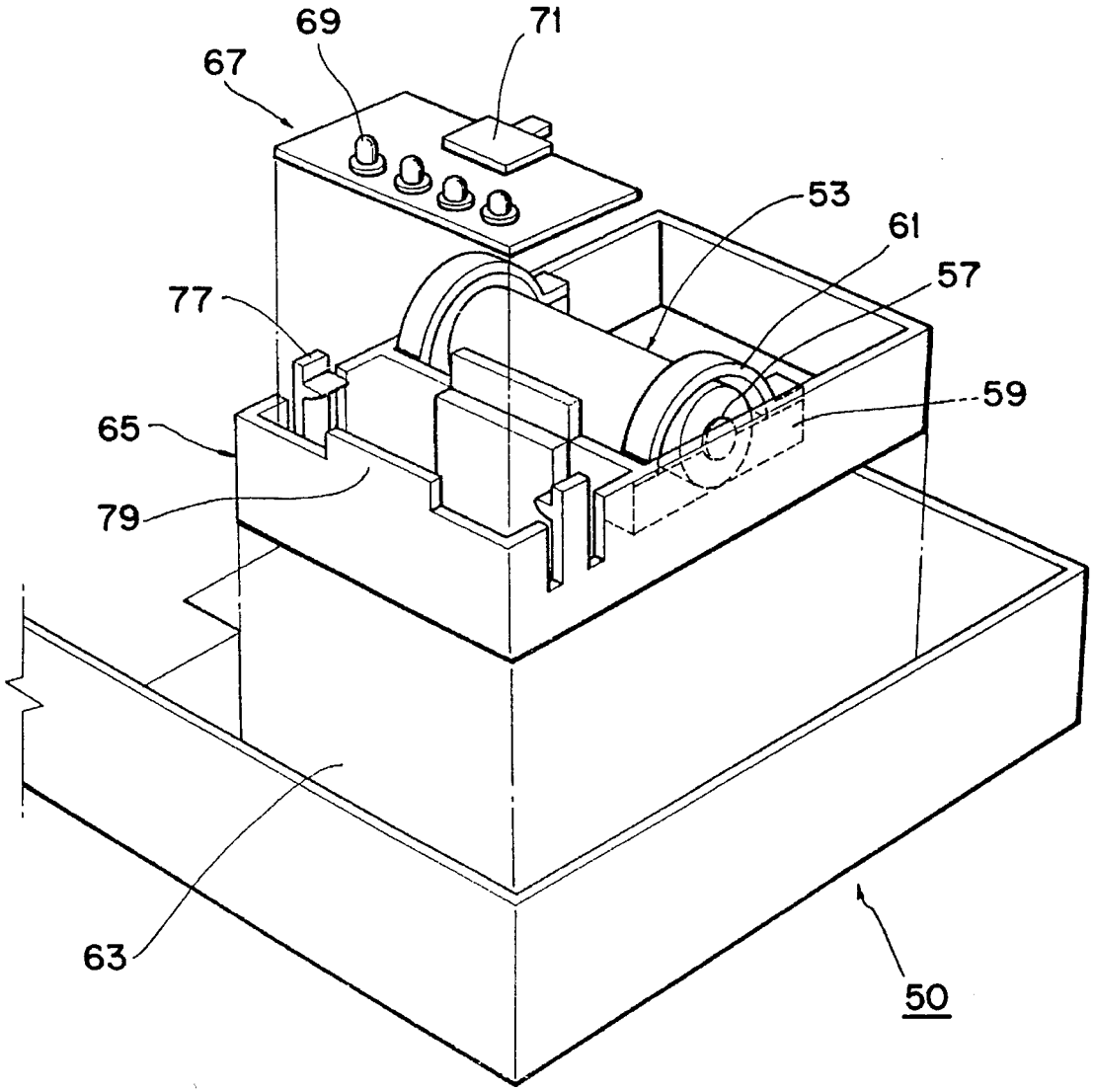
FIG. 12 (PRIOR ART)
FIG. 12 is an exploded perspective view of the electrical components housed in the indoor unit of to FIG. 8.

A motor mounting plate 52, shown in FIG. 7, comprises bearing members 59 (only one being shown) mounted on the rear case 50 for supporting couple of shafts 57, which are formed on both ends of the motor 53. Further, once a shaft 57 is placed in its bearing member 59, a bracket 61 is attached to the bearing member 59 by bolts or similar functional fastening means, bracket covers the shaft 57. Furthermore, a plate 54 is provided on the upper surface of the bracket 61. The plate 54 carries a wire holding member 60 and a collecting panel 62 for installing the wire 56 and various circuit parts 58.

Next, in the lower portion of the motor holding plate 52, or adjacent to the outlet opening 13, an electrical components mounting board 67 is provided, and placed on a supporting member 68. The upper edge of the supporting member 68, or the edge adjacent to the plate 54 slopes upwards. Lips 72 are formed on upper edge of the supporting member 68, while a gripping member 74 is provided on the lower edge thereof. The gripping member 74 grips the front area of the mounting board 67 and the upper portion of the gripping member 74 can flexibly move in front and rear directions. If the board 67 is supported beneath the lips 72 and held by the gripping member 74, the board 67 can not move in front and rear directions.

When the gripping member 74 is pulled toward the lower wall of the rear case 50, the mounting board 67 can be easily disassembled from the supporting member 68. A protuberance 76 is uprightly mounted in the supporting member 68. The mounting board 67 has a slot 78 which allows the introduction of the protuberance 76. As the board 67 is placed in the supporting member 68, while being restricted by the lips 72 and the gripping member 74, the protuberance 76 can be inserted into the slot 78. Thus, the lips 72 and the gripping member 74 prevent the board from moving in a frontwards or backwards direction, or sideways along the side wall of the rear case 50, and the protuberance 76 and the slot 78 restrict the movement of the board 67 in right or left directions, or sideways along the shaft extending direction.

In addition, the board 67 provides a plurality of lamps 69 comprised of L.E.D. in the central portion of the board 67, for displaying the operation condition. The display of the lamp 69 can be seen through the visual window 12 formed on the front case 10 (FIG. 1). Users can identify the condition of the operation. Further, adjacent to the central upper edge of the board 67, an operation switching component 71 is provided, for selecting the automatic mode—controlled by the remote controller, or the manual mode, for the operation of the indoor unit. That is, the front case 10 can be opened and the switching component 71 can be moved in a right or left direction, i.e. to select the automatic or manual mode.

In the indoor unit built as described, the upper edge of the supporting member 68 slopes upward. Further, in the respective upper front and rear areas of the supporting member 68, a gripping member 74 and lips 72 are formed. Thus, the gripping member 74 and lips 72 retain the board 67. Further, the slot 78 receives the protuberance 76 when the board 67 is placed on the supporting member 68.

In other words, by means of a gripping member 74 and lips 72, which are formed on the front and rear wall of the supporting member 68 respectively, the board 67 can not move in front or rear directions. When the protuberance 76 is inserted through the slot 78, the board 67 is no longer able to move in left or right directions. Further, since the upper wall of the supporting member 68 slopes upward, the controlabilty is simple. That is, with the body hung on the wall, and the supporting member 68, mounted at the rear surface of the grill member 20, is slopedly shaped, the handling is easy.

On the right side of the motor mounting plate 52 i.e. the inner side wall of the rear case 50, a couple of opposing recesses 82 are provided. The recesses 82 secure the circuit board 84, which has various electronic components, parallel to the side wall of the rear case 50.

Figure 2:
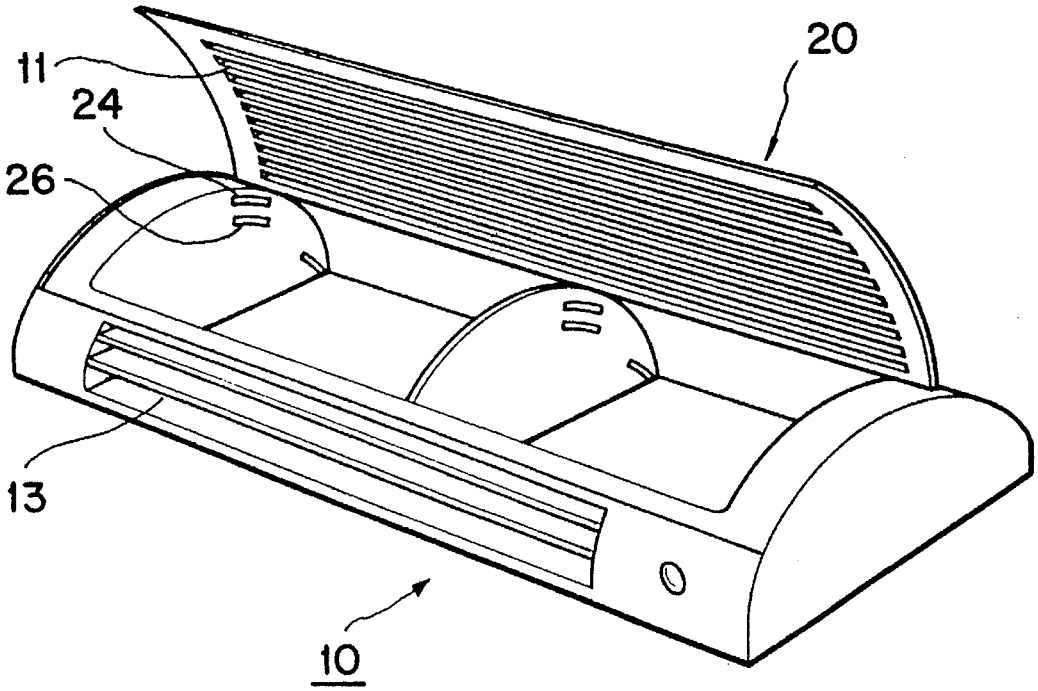
FIG. 2 is a perspective view of a front case of the unit of FIG. 1 having the grill member opened.
Figure 3:
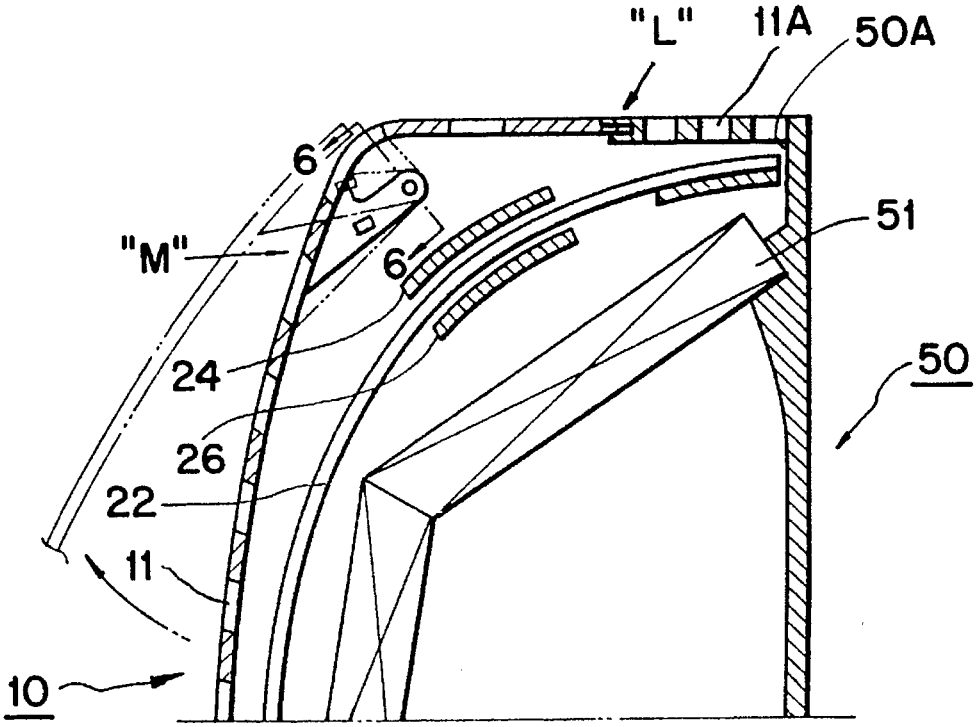
FIG. 3 is a vertical cross-sectional view of the assembled indoor unit of to FIG. 1.

An auxiliary or top intake opening 11A is provided in the upper portion of the rear case 50 (FIGS. 1 and 3), through which the air is introduced into the heat-exchanger 51. Further, a couple of filter guiding members 24,26 protrude toward the front case 10, so that the filter 22 can extend upward toward the opening 11A (FIGS. 2 and 3). The outer surface of the filter 22 slides on the outer filter guiding member 24, while the inner surface of the filter 22 slides on the inner filter guiding member 26.

A long the filter guiding members 24,26, the upper edge of the filter 22 is guided to the inner upper surface of the front case 10 and finally reaches the inner upper surface 50A of the rear case 50, which finishes the installation of the filter.

The grill member arranged on the front case 10 is provided as shown in FIG. 5. A couple of brackets 44 are integrally formed by injection molding on both upper side ends of the grill member 20. In the front case 10 a couple of openings 36, for accessing the bracket 44 of the grill member 20, are provided. Further, another couple of brackets 34 are also integrally formed by injection molding on the inner portion of respective openings 36.

Brackets 44,34 have respective openings 42,32. Both openings 42,32 are linked by a pin 38 having an enlargement 40 on the leading portion. Once the pin 38 is inserted, the pin 38 can not fall out freely.

Furthermore, a protrusion 46 is provided on the side surface of the bracket 44 of the grill member 20, i.e. opposite to the bracket 34 of the front case 10. A supporting member 48 is provided in the access opening 36 of the front case 10. The protrusion 46 rests on the supporting member 48 when opening the grill member 20, and as a consequence, the grill member 20 can not be closed freely or by a mere lightly applied force.

The brackets 44,34 are assembled as shown in FIG. 6. The bracket 44 of the grill member 20 is inserted into the opening 36 of the front case 10 . In this condition, the right side of the bracket 44 of the grill member 20 contacts the left side of the bracket 34 of the front case 10. After aligning the openings 42,32 the pin 38 is inserted. When the enlargement 40 of the pin 38 inserted into the openings 42,32, the enlargement 40 is squeezed smaller. After the enlargement 40 of the pin 38 passes through openings 42,32, the enlargement 40 swells back to the natural shape, thereby preventing the pin from slipping out freely. Therefore, by use of a pin 38, the bracket 44 of the grill member 20 is attached to the bracket 34 of the front case 10 in a hinged condition.

During the air intake process through the intake opening 11, dust or foreign materials are collected in the filter 22 (FIG. 3). When a certain amount of dust has gathered in the filter 22, the grill member 20 can be swung upward about the pin 38, whereupon the bracket 44 of the grill member 20 passes through the opening 36. After the opening of the grill member 20, the supporting member 48 of the front case 10 is elastically deformed by the protrusion 46 on the bracket 44. Next, the protrusion 46 is supported on the supporting member 48. In this condition, the user's hand which is holding the grill member 20, is released. That is, since the protrusion 46 is resisting on the supporting member 48, the grill member cannot be closed freely.

With the grill member 20 in the open condition, the filter 22 is removed from the grill member 20 and dust is swept off the filter 22. The cleaned filter 22 is reinstalled into the grill member 20. As a downward force is applied to the grill member 20, the protrusion 46 pushes past the supporting member 48 and re-enters the access opening. Finally, the grill member 20 is closed.

As shown in FIG. 4, a platform 15 is formed on the rear upper edge of the front case 10, while an overlapping member 73 is formed on the front upper edge of the rear case 50. That is, the front case 10 is assembled with the rear case 50 in such a condition that the overlapping member 73 rests on the platform 15.

Further, a plurality of ribs 86 are provided on the undersurface of the overlapping member 73 to support the platform 15. That is, the overlapping member 73 is placed on the platform 15 and the ribs 86 support the underside of the platform 15. As the rear case 51 approaches the front case 10 in a horizontal manner, the ribs 86 and the overlapping member 73 receive the platform 15 in a slot formed therebetween.

In an assembled condition, when an external force F is applied to the upper portion of the rear case 50, the platform 15 deflects with the overlapping member 73 without creating a gap between the platform 15 and the overlapping member 73. Further, if the external force F1 is applied to the upper portion of the front case 10, the ribs 86 support the platform 15 to prevent the creation of a substantial gap between the platform 15 and the overlapping member 73.

According to the structure of the indoor unit of an air conditioner, this invention has a variety of advantages as follows.

Since the indoor air is drawn in through the intake opening, formed on the front and rear portion of the indoor unit, heat-exchange efficiency can be increased. Further, the air can be drawn on a diverging surface so that noise generated from the intake process is reduced. Furthermore, formed on the inside of the front case are the guiding members, between which the filter can easily be mounted to the rear surface of the grill member is greater conformance to the opening formed therein. This leads to increased efficiency of the air cleaning process.

Because the circuit board can be placed on the upper portion of the bracket covering the motor, various circuit parts and wires can be mounted on the upper surface of the board. As a result there is no need to maintain additional space for installation of the components, thus the indoor unit is more compact.

Further, the electrical components mounting board which includes a lamp displaying the operation condition of the indoor unit, and operating switching components for selecting the automatic or manual modes, is placed on the sloped supporting member, so an additional box for receiving the mounting board is not needed.

Furthermore, respective brackets are integrally formed on the front and rear case by injection molding, and a pin having a neck is inserted into the openings of the respective brackets. Thus the front case is assembled with the rear case in a hinging manner, consequently achieving quick assembly and reducing the number of components.

Finally, a plurality of ribs are integrally provided under the overlapping member of the rear case and upon which the platform of the front case can rest. Therefore, upon the application of an external force to the front case cannot form a gap between the front and rear cases.

What is claimed is:

1. An indoor unit of an air conditioning system, comprising front and rear cases connected to one another to define a space; a grill member hingedly mounted on said front case and forming a front air intake opening communicating with said space; a filter mounted on a rear side of said grill member and extending across said front air intake opening; said rear case including a top air intake opening formed in an upper side thereof; a heat exchanger and fan disposed in said space; a motor disposed in said space for driving said fan to draw-in air through said front and top air intake openings; said front case having a pair of first brackets disposed at upper portions of respective ends of a rear side of said front case; said front case including an access opening adjacent each first bracket; said grill member including a pair of second brackets arranged to be inserted through respective ones of said access openings to be positioned adjacent a respective first bracket; a hinge pin extending through aligned holes of each first bracket and its respective second bracket; each hinge pin including enlargements at each of its ends for retaining said hinge pins in said aligned holes; said front and rear cases having overlapping edge portions; one of said edge portions including outer and inner elements spaced apart to form a slot for receiving said other edge portion.

2. The indoor unit according to claim 1, further including spaced-apart securing elements mounted on said rear case and disposed in said space; and a circuit board electrically connected to said motor being secured by said securing elements.

3. The indoor unit according to claim 1 further including a board carrying electrical switches and display lamps mounted on said rear case and disposed in said space, said rear case including a supporting member on which said board is secured to lie at an oblique angle relative to a rear wall of said rear case, said supporting member including an arrangement for preventing said board from moving in any direction.

4. The indoor unit according to claim 3 wherein said arrangement comprises a lip structure overlying one edge of said board, a resilient gripping member overlying an opposite edge of said board; and a protrusion extending through a slot in said board.

5. The indoor unit according to claim 1 further including a bracket mounted on said rear case and disposed in said space, said motor disposed in said bracket; a plate mounted on said rear case and disposed in said space in front of said bracket; said plate carrying a holding member which clamps an electric wire.

6. The indoor unit according to claim 1 wherein one of said second brackets includes a protrusion, and one of said access openings includes a supporting member positioned to be engaged by said protrusion when said grill member is in an upwardly swing state to releasably retain said grill member in said upwardly swing state.

7. The indoor unit according to claim 1 wherein an upper portion of said filter underlies said top air inlet opening.

8. The indoor unit according to claim 7 wherein said rear side of said grill member includes a guide structure for guiding said filter for sliding movement upwardly to said underlying relationship with said top air inlet opening.

* * * * *